US009417567B1

(12) United States Patent
Kadota et al.

(10) Patent No.: US 9,417,567 B1
(45) Date of Patent: Aug. 16, 2016

(54) IMAGE FORMING APPARATUS

(71) Applicant: KYOCERA Document Solutions Inc., Osaka (JP)

(72) Inventors: Masaki Kadota, Osaka (JP); Ai Takagami, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/775,756

(22) PCT Filed: Apr. 22, 2015

(86) PCT No.: PCT/JP2015/062292

§ 371 (c)(1),
(2) Date: Sep. 14, 2015

(87) PCT Pub. No.: WO2015/198705

PCT Pub. Date: Dec. 30, 2015

(30) Foreign Application Priority Data

Jun. 23, 2014 (JP) ..... 2014-127823

(51) Int. Cl.
*G03G 15/16* (2006.01)

(52) U.S. Cl.
CPC ..... *G03G 15/1665* (2013.01); *G03G 15/1675* (2013.01)

(58) Field of Classification Search
CPC ..... G03G 15/1665; G03G 15/1675
See application file for complete search history.

(56) References Cited

U.S. PATENT DOCUMENTS 5,832,335 A * 11/1998 Fukasawa ..... G03G 15/1675 399/101
6,324,354 B1 11/2001 Tode et al.
2003/0039479 A1 2/2003 Takahashi
2009/0290889 A1* 11/2009 Tsukamura ..... G03G 15/1675 399/45

FOREIGN PATENT DOCUMENTS

JP 2000-310909 11/2000
JP 2003-057919 2/2003
JP 2010-134320 6/2010
JP 2014-178376 9/2014

* cited by examiner

*Primary Examiner* — Sandra Brase
(74) *Attorney, Agent, or Firm* — Wenderoth, Lind & Ponack, L.L.P.

(57) ABSTRACT

The image forming apparatus, which includes a plurality of photosensitive drums, charging devices that contact and charge respective photosensitive drums, developing devices that attach toner including a metal particle, which is a polishing particle, and develop latent images, and cleaning devices that remove remaining toner from surfaces of the photosensitive drums and allows toner images of each color formed on the photosensitive drums to be sequentially superposed on an intermediate transfer belt to form a color image, has a primary transfer bias control unit that switches polarity of primary transfer bias, except for a time of image formation on the photosensitive drums, to polarity equal to or opposite to electrostatic charge of toner in response to an average printing rate of each color of a predetermined number of immediately previous papers.

5 Claims, 4 Drawing Sheets

IMAGE FORMING APPARATUS

BACKGROUND

The present invention relates to an image forming apparatus used in, for example, a copy machine, a printer, a facsimile and the like.

In a full color image forming apparatus, an electric latent image is configured to be formed on peripheral surfaces of a plurality of photosensitive drums, which respectively correspond to each color of yellow (Y), magenta (M), cyan (C), and black (BK), by using a laser scanning unit, and toner images of each color are configured to be respectively generated by toner of each color.

The toner images of each color generated on the peripheral surfaces of the photosensitive drums are sequentially superposed and transferred to an intermediate transfer belt that endlessly travels, so that a color image is synthesized on the intermediate transfer belt. Next, the color image synthesized on the intermediate transfer belt is configured to be transferred to a sheet material including a paper and the like by using a transfer roller and then to be pressed and heated in a fixing device, resulting in a formation of a color image. Toner remaining on the surface of a photoreceptor without being transferred in a primary transfer unit is collected in a cleaning device of the photoreceptor and the collected toner is attached to the surface of a polishing roller, so that the photoreceptor is polished.

In many cases, in toner, silica for providing fluidity and metal particles, which are polishing particles for providing a polishing property, is used. Since the metal particles have lower electric resistance and also have a lower electric charge amount as compared with the silica and the like, they are easily detached from toner particles and easily remain on the surface of a photoreceptor without being transferred to the intermediate transfer belt in the primary transfer unit. Therefore, when a printing rate of an image becomes high, a ratio of the metal particles of the toner collected in the cleaning device becomes high.

Since an outer diameter of the metal particle is very small (about 1/100 of the toner particle), the metal particle passes through a cleaning blade and is attached to a charging device of a downstream side, so that the contamination of the charging device is promoted.

A tandem type color machine has a plurality of photosensitive units of yellow, cyan, magenta, black and the like, but since printing rates of each color are largely different from one another in many cases, a difference occurs in rates of metal particles of toner collected in cleaning devices of each image forming station (hereinafter, simply referred to a "station"), so that a difference easily occurs in contamination levels of charging devices.

On the other hand, when the ratio of the metal particles of the collected toner is low, dielectric breakdown of a photoreceptor easily occurs. That is, since the metal particles of the collected toner release an electric charge, when the ratio of the metal particles of the collected toner is low, the toner is excessively electrified by friction in the cleaning device. Furthermore, when the toner is peeled from the photoreceptor by the cleaning blade, the toner is discharged to the photoreceptor, so that the dielectric breakdown of the photoreceptor easily occurs.

Consequently, it is preferable that the ratio of the metal particles of the collected toner is maintained in a predetermined range. Conventionally, for example, as disclosed in Patent Literature 1, bias of a cleaning brush of an intermediate transfer belt is turned OFF, and cleaning of the intermediate transfer belt is suspended. During one rotation of the intermediate transfer belt, toner remaining on the intermediate transfer belt is supplied to the photosensitive drum.

CITATION LIST

Patent Literature

Patent literature 1: Japanese Unexamined Publication No. 2010-134320

However, in Patent Literature 1, since an operation execution timing should be after a printing operation is ended or the operation needs to be performed after temporally stopping the printing operation, toner which can be supplied to a drum unit is only toner remaining on an intermediate transfer belt in an immediately previous printing operation, resulting in a problem that achievable effects are limited.

The present invention is achieved in view of such points described above and an object of the present invention is to provide an image forming apparatus capable of maintaining a ratio of metal particles of collected toner in a predetermined range, thereby suppressing contamination of a charging device and dielectric breakdown of a photoreceptor.

SUMMARY

An image forming apparatus of the present invention, which includes a plurality of photoreceptors, charging devices that contact and charge respective photoreceptors, developing devices that attach toner including a metal particle, which is a polishing particle, and develop latent images, and cleaning devices that remove remaining toner from surfaces of the photoreceptors and allows toner images of each color formed on the photoreceptors to be sequentially superposed on an intermediate transfer belt to form a color image, has a primary transfer bias control unit that switches polarity of primary transfer bias, except for a time of image formation on the photoreceptors, to polarity equal to or opposite to electrostatic charge of toner in response to an average printing rate of each color of a predetermined number of immediately previous papers.

According to the present invention, it is possible to maintain a ratio of metal particles, which are polishing particles of collected toner in a cleaning device, in a predetermined range. Consequently, it is possible to suppress contamination of a charging device of each station due to metal particles and dielectric breakdown of a photosensitive drum.

DETAILED DESCRIPTION

Hereinafter, an embodiment of the present invention will be described in detail with reference to the drawings. In addition, hereinafter, a copy machine will be exemplified as an image forming apparatus according to the present invention.

Figure 1:
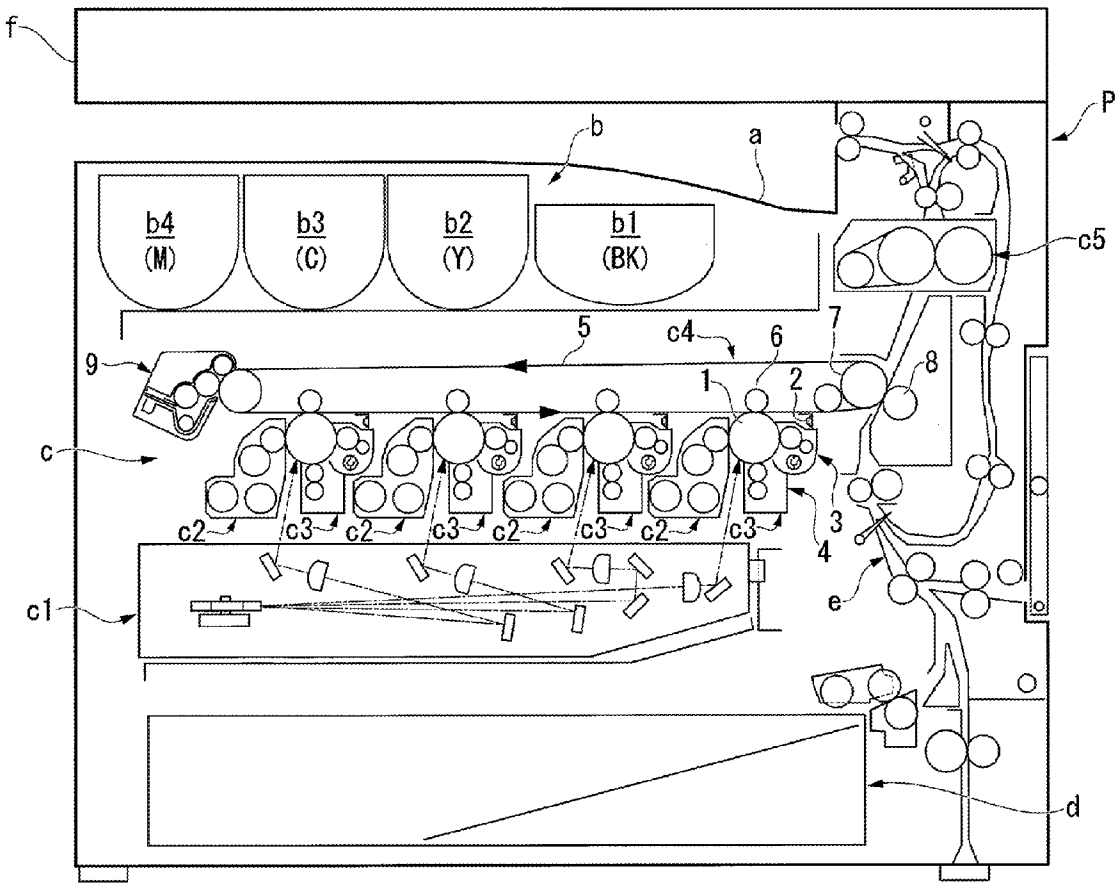
FIG. 1 is a schematic configuration diagram of a copy machine according to an embodiment of the present invention.

FIG. 1 is a schematic configuration diagram of a copy machine p in an embodiment of the present invention. The copy machine (an image forming apparatus) p includes a paper discharge unit a, a toner cartridge accommodating unit b, an image forming unit c, and a paper cassette unit d. Furthermore, the copy machine p is provided with a paper conveying unit e from the paper cassette unit d positioned in the lower part to the paper discharge unit a positioned in the upper part. Furthermore, the copy machine p is provided with a scanner unit f positioned above the paper discharge unit a to read a document.

The paper discharge unit a is configured to discharge a paper (a sheet material) with a predetermined formed image via the paper conveying unit e. A bottom surface of the paper discharge unit a is inclined, and when a plurality of papers are discharged, it is designed that one end side can be aligned and stacked.

The toner cartridge accommodating unit b is configured to be able to accommodate a toner cartridge b1 of black toner (BK), a toner cartridge b2 of yellow toner (Y), a toner cartridge b3 of cyan toner (C), and a toner cartridge b4 of magenta toner (M). Each of the toner cartridges b1 to b4 is configured to be able to supply toner to a developing unit c2 of the image forming unit c.

The image forming unit c is configured to include a laser scanning unit c1, the developing unit c2, a drum unit c3, a transfer unit c4, and a fixing unit c5. The developing unit c2 and the drum unit c3 are provided corresponding to the toner cartridges b1 to b4 in a one-to-one manner.

The laser scanning unit c1 is configured to include a light beam generator for generating a laser beam, a polygon mirror for scanning the light beam irradiated from the light beam generator, a fθlens for forming an image of the light beam scanned by the polygon mirror on a photosensitive drum 1 to be described later, and the like, similarly to a well-known laser scanning unit.

The developing unit c2 supplies toner to the photosensitive drum 1 to develop an electrostatic latent image formed on a peripheral surface of the photosensitive drum 1, and is arranged to face the peripheral surface of the photosensitive drum 1 in a radial direction thereof.

The drum unit c3 includes the photosensitive drum 1 having the peripheral surface, on which the electrostatic latent image is formed using the laser scanning unit c1 and a toner image is formed by the toner supplied to the developing unit c2 from the toner cartridge accommodating unit b.

Around the photosensitive drum 1, an electricity removing lamp 2 for removing electricity of the peripheral surface after transfer, a cleaning device 3 for removing toner remaining on the peripheral surface after the transfer, and a charging device 4 for allowing the peripheral surface to be in a charged state before the transfer are arranged to face the photosensitive drum 1. The electricity removing lamp 2, the cleaning device 3, and the charging device 4 of the present embodiment are integrally unitized as the drum unit c3 together with the photosensitive drum 1 so as to be freely detachable.

The transfer unit c4 has an intermediate transfer belt 5 onto which the toner image is transferred from the photosensitive drum 1, a primary transfer roller 6 arranged to face the photosensitive drum 1 while interposing the intermediate transfer belt 5 between the photosensitive drum 1 and the primary transfer roller 6, secondary transfer rollers 7 and 8 which secondarily transfer the toner image transferred onto the intermediate transfer belt 5, and a cleaning brush 9 which cleans the intermediate transfer belt 5. When a predetermined sheet material, for example, a paper, is conveyed via the paper conveying unit e, the secondary transfer rollers 7 and 8 rotate in a state in which the paper on the intermediate transfer belt 5 is interposed between the secondary transfer rollers 7 and 8, so that secondary transfer is performed for the paper and thus it is possible to convey the paper to the fixing unit c5 side.

The fixing unit c5 is provided at a part of the paper conveying unit e of a downstream side from a position at which the transfer unit c4 is provided, and is configured with a pair of rollers arranged to be able to interpose the paper conveyed through the paper conveying unit e therebetween. Furthermore, the fixing unit c5 is configured to be able to fix the toner image of the paper, which has been transferred from the transfer unit c4, on the paper by pressing and heating the toner image by the pair of rollers.

The paper cassette unit d is a paper feeding cassette provided to be freely drawn out with respect to an apparatus body. Furthermore, the paper cassette unit d is configured to be able to supply papers from the paper feeding cassette to the paper conveying unit e one by one.

The paper conveying unit e is provided from the paper cassette unit d positioned below to the paper discharge unit a positioned above, and is configured by a plurality of conveying rollers and a guide plate. Furthermore, the paper conveying unit e is configured to be able to convey papers supplied from the paper cassette unit d toward the paper discharge unit a one by one.

In the copy machine P having the aforementioned configuration, laser light corresponding to image data is irradiated to the photosensitive drum 1 from the laser scanning unit c1, the electrostatic latent image is formed, and the toner image is developed by supplied toner. Furthermore, after the toner image carried on the photosensitive drum 1 is transferred to a paper by the transfer unit c4, the toner image is subjected to the fixing process in the fixing unit c5 through pressing and heating. Finally, a paper with the printed image is discharged to the paper discharge unit a.

Figure 2:
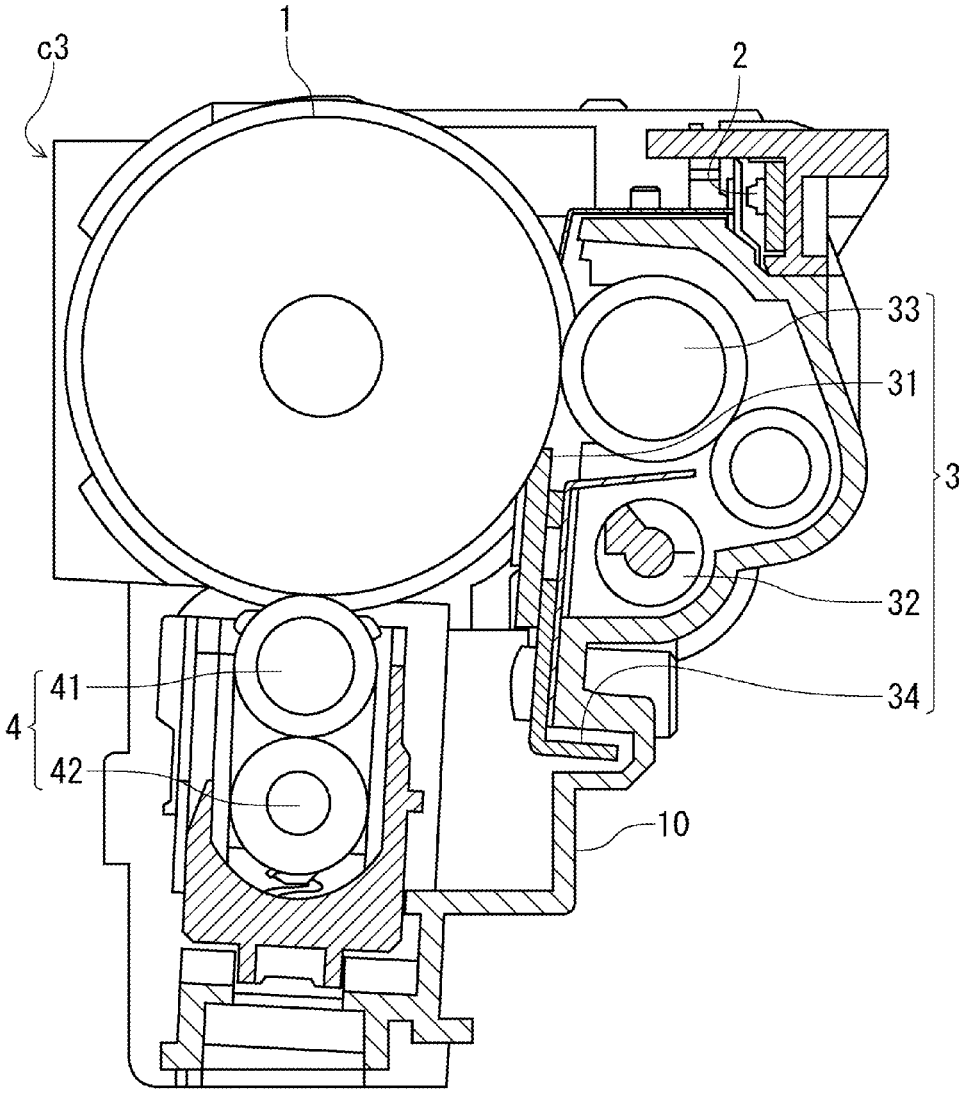
FIG. 2 is a sectional view illustrating a configuration of a drum unit according to an embodiment of the present invention.

FIG. 2 is a sectional view illustrating a configuration of the drum unit c3. In the drum unit c3, around the photosensitive drum 1, the electricity removing lamp 2, the cleaning device 3, and the charging device 4 are arranged so as to face the photosensitive drum 1. The electricity removing lamp 2, for example, is a light emitting diode (LED).

The drum unit c3 has a unit frame body 10 that holds the photosensitive drum 1. The unit frame body 10 is an element which integrally holds the photosensitive drum 1, the cleaning device 3, and the charging device 4. The cleaning device 3 is arranged at a lateral side of the photosensitive drum 1 and the charging device 4 is arranged below the photosensitive drum 1.

The cleaning device 3, the photosensitive drum 1, and the charging device 4 are integrally configured as the drum unit c3 (an image carrying unit). The cleaning device 3 is provided at both end portions in a right and left direction (a direction perpendicular to the paper surface of FIG. 2) with a pair of side plates (support bodies: not illustrated). By the pair of side plates, the photosensitive drum 1 is rotatably supported. Furthermore, by the pair of side plates, the charging device 4 and the cleaning device 3 are supported to face the photosensitive drum 1.

The cleaning device 3 includes a cleaning blade 31, a conveying screw 32, and a polishing roller 33, and cleans toner attached to the peripheral surface of the photosensitive drum 1 after the tone image transfer and conveys the toner to a collecting device (not illustrated).

The cleaning blade 31 is a plate-shaped member made of a rubber material (urethane rubber and the like). The cleaning blade 31 is supported to the unit frame body 10 by a blade holder 34. The blade holder 34 is a sheet metal member having an L shape when viewed from the aforementioned sectional view. The cleaning blade 31 and the blade holder 34 are fixed by an adhesive. As a consequence, a fixed end of the cleaning blade 31 is formed. On the other hand, a front end of the cleaning blade 31 is a free end and abuts the peripheral surface of the photosensitive drum 1. The aforementioned front end of the cleaning blade 31 abuts a cylindrical surface of the photosensitive drum 1 at a downstream side in a rotation direction other than the polishing roller 33 to be described later. As a consequence, by the aforementioned front end of the cleaning blade 31, toner remaining on (attached to) the peripheral surface of the photosensitive drum 1 is removed.

The conveying screw 32 is rotatably supported to a cleaner housing above the cleaning blade 31. The conveying screw 32 has an axis and a spiral blade member arranged around the axis. The conveying screw 32 conveys collected toner, which has been scraped by the cleaning blade 31 and accumulated on the cleaning blade 31, in an axial direction of a rotating shaft of the photosensitive drum 1.

The polishing roller 33 is arranged at a rear side of the conveying screw 32. The polishing roller 33 is a rubber roller having a surface subjected to a roughening treatment. The polishing roller 33 is rotated according to the photosensitive drum 1 while abutting the surface of the photosensitive drum 1. The polishing roller 33 collects toner attached to the cylindrical surface of the photosensitive drum 1. Furthermore, the polishing roller 33 polishes attachment such as discharge products attached to the surface of the photosensitive drum 1. At this time, a predetermined amount of toner is attached to the peripheral surface of the polishing roller 33, so that the removal performance (polishing performance) of the aforementioned discharge products is improved.

The charging device 4 includes a charging roller 41 and a cleaning roller 42. The charging roller 41 is a roll member having a surface made of a rubber material. The charging roller 41 receives a charging voltage from a bias applying unit (not illustrated). The charging roller 41 abuts the peripheral surface of the photosensitive drum 1 and is rotated according to the photosensitive drum 1. By the charging roller having received the charging voltage, the peripheral surface of the photosensitive drum 1 is uniformly charged.

The cleaning roller 42 abuts the charging roller 41 and rotates with a linear velocity difference with the charging roller 41. The cleaning roller 42 is a brush roller formed with a conductive nylon fiber. The charging roller 41 abuts the surface of the photosensitive drum 1, so that toner, a foreign matter and the like are attached to the surface of the photosensitive drum 1. Furthermore, the charging voltage is applied to the charging roller 41 and discharge occurs at an abutting position with the charging roller 41, so that discharge products are attached to the surface of the charging roller 41. The cleaning roller 42 is rotated with the linear velocity difference while making contact with the charging roller 41, so that the toner, the foreign matter and the like are attached to the surface of the photosensitive drum 1 are preferably removed.

(Hardware Configuration of Copy Machine P)

Figure 3:
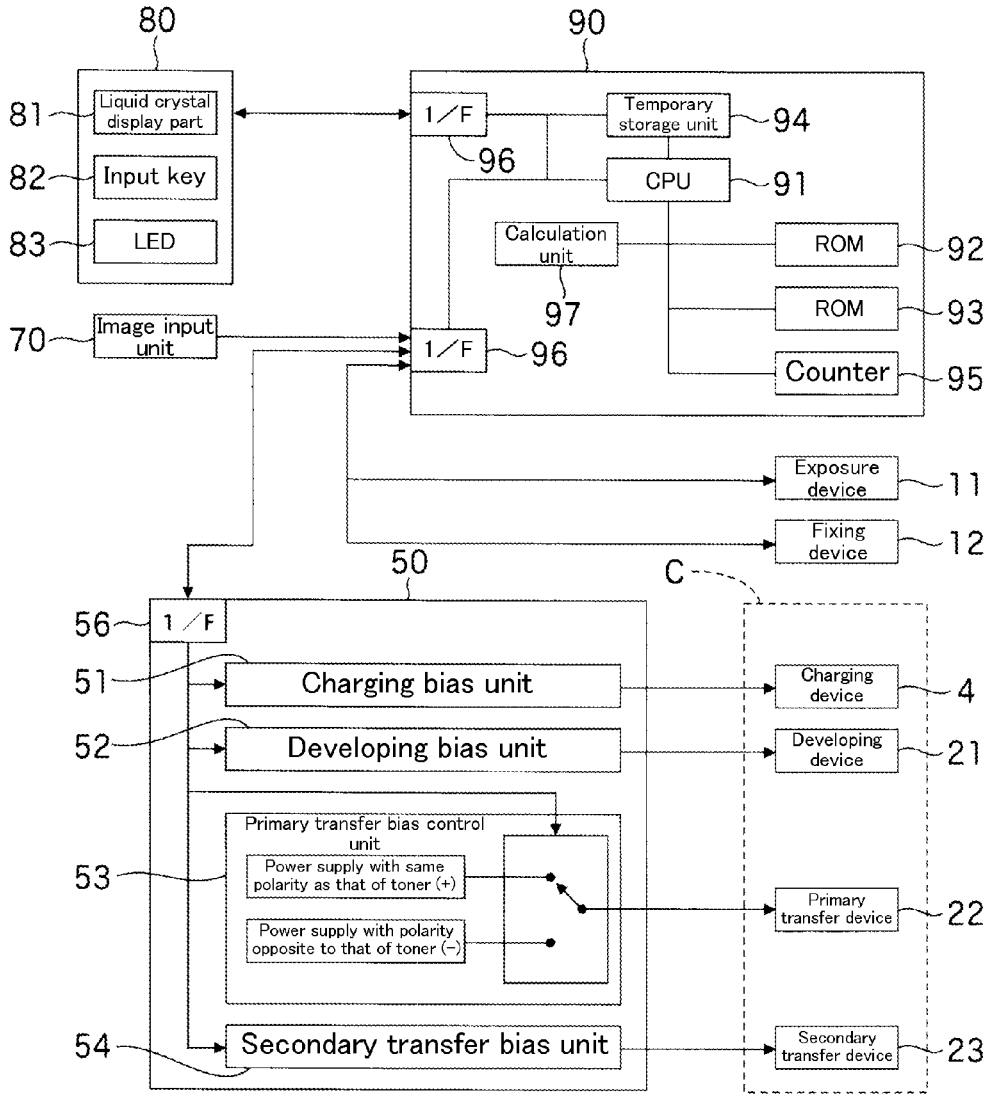
FIG. 3 is a block diagram illustrating an example of a hardware configuration of a copy machine according to an embodiment of the present invention.

Next, with reference to FIG. 3, the hardware configuration of the copy machine P according to an embodiment of the present invention will be described. FIG. 3 is a block diagram illustrating an example of the hardware configuration of the copy machine P.

As illustrated in FIG. 3, the copy machine P according to the present embodiment has a control unit 90, an operating unit 80, an image input unit 70, a high voltage power supply 50, an exposure device 11, a fixing device 12, the image forming unit c and the like.

The control unit 90 includes a CPU (Central Processing Unit) 91, a ROM (Read Only memory) 92 serving as a read only storage unit, a RAM (Random Access memory) 93 serving as a freely readable/writable storage unit, a temporary storage unit 94 for temporarily storing image data and the like, a counter 95, a plurality of (herein, two) I/Fs (interfaces) 96 for transmitting a control signal to each device in the copy machine P and receiving an input signal from the operating unit 80, and a calculation unit 97 for performing a calculation process of numerical values required for control. In addition, the control unit 90 can be arranged at an arbitrary place in the apparatus body.

Furthermore, the control unit 90 transmits a control signal to each part and device in the copy machine P from the CPU 91 through the I/F 96. Furthermore, signals or input signals indicating the states of each part and device are transmitted to the CPU 91 from each part and device through the I/F 96. Each part controlled by the control unit 90, for example, includes the image forming unit c, the high voltage power supply 50, the exposure device 11, the fixing device 12, the operating unit 80, and the like.

The CPU 91 is a central processing unit and performs the control and calculation of each part of the copy machine P on the basis of a developed control program. The ROM 92 stores data and the like, which are not changed during the use of the copy machine P, such as a program for control of the copy machine P and numerical values required for control. The RAM 93 stores required data generated in the course of the control of the copy machine P, data temporarily required for the control of the copy machine P, and the like. Furthermore, the RAM 93 (or the ROM 92) stores the number of printed papers and the like serving as a trigger of a cleaning operation. The counter 95 accumulates and counts the number of printed papers.

The calculation unit 97 calculates a printing rate of an image and an average printing rate of a predetermined number of images on the basis of the image data stored in the temporary storage unit 94. In the present embodiment, the calculation unit 97 calculates an average printing rate per one paper from image data formed on the photosensitive drum, which corresponds to immediately previous 100 papers. In addition, the average printing rate is an index indicating an area of a region in which an image is formed with respect to an area of an entire paper.

The high voltage power supply 50 has a charging bias unit 51, a developing bias unit 52, a primary transfer bias control unit 53, a secondary transfer bias unit 54, and an I/F (interface) 56. The charging bias unit 51 applies (outputs) predetermined bias to the charging roller 41 (see FIG. 2) of the charging device 4 by an output signal from the control unit 90. The developing bias unit 52 applies (outputs) predetermined bias to a developing roller of a developing device 21 by the output signal from the control unit 90. The primary transfer bias control unit 53 switches the polarity of predetermined bias to polarity equal to or opposite to the electrostatic charge of toner and applies (outputs) the predetermined bias to the primary transfer roller 6 (see FIG. 1) of a primary transfer device 22 by the output signal from the control unit 90. The secondary transfer bias unit 54 applies (outputs) predetermined bias to the secondary transfer rollers 7 and 8 (see FIG. 1) of a secondary transfer device 23 by the output signal from the control unit 90.

The image input unit 70 is a reception unit that receives image data transmitted to the copy machine P from a personal computer and the like. An image signal input by the image input unit 70 is converted to a digital signal and then is sent to the temporary storage unit 94.

The operating unit 80 is provided with a liquid crystal display part 81, an input key 82, and an LED 83. The liquid crystal display part 81 and the LED 83 are configured to indicate the state of the copy machine P or display an image forming status and the number of printed papers. Various types of setting of the copy machine P is performed from a printer driver of a personal computer.

In addition, the operating unit 80 is provided with a stop/clear button used when stopping image formation and the like, a reset button used when allowing various types of setting of the copy machine P to be in a default state.

Figure 4:
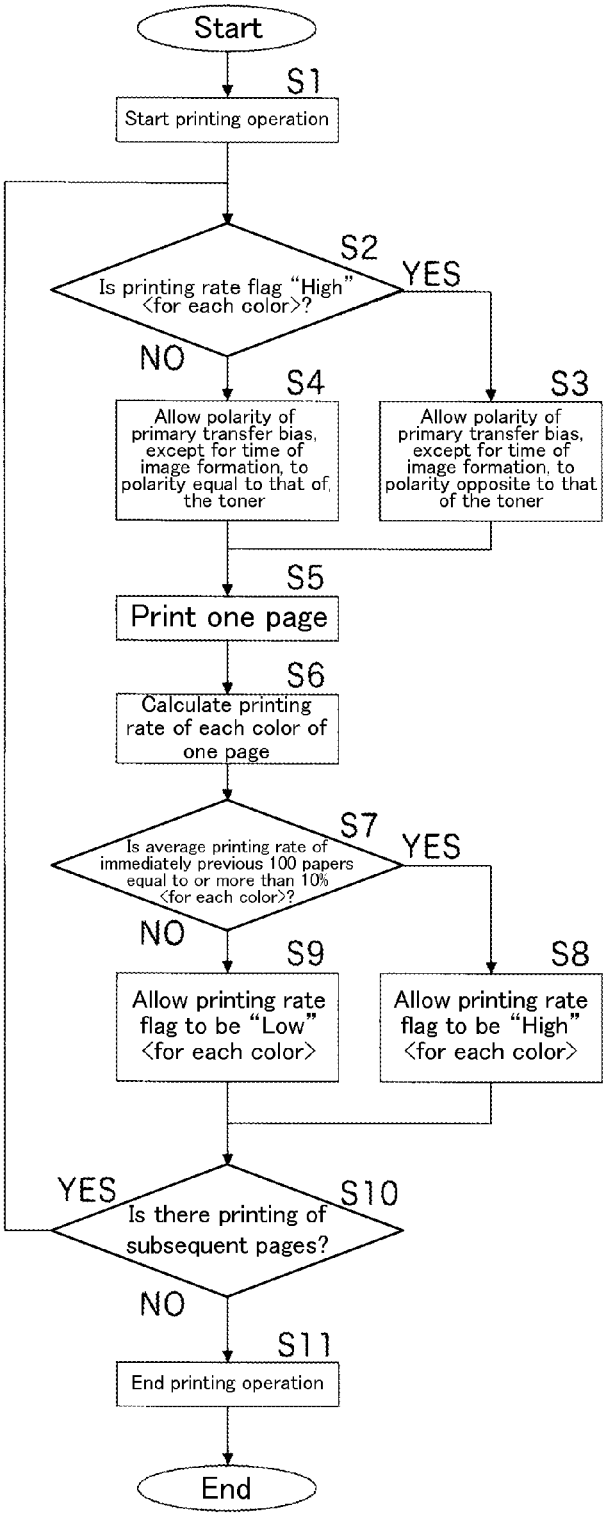
FIG. 4 is a flowchart illustrating a control procedure of a copy machine according to an embodiment of the present invention.

FIG. 4 is a flowchart illustrating a control procedure of the copy machine P according to an embodiment of the present invention.

A printing operation by the copy machine P is started by a printing command (step S1), and it is determined whether a printing rate flag of each color is "High" or "Low" (step S2). In addition, the first stage, which is a shipment state of a product, is "Low", and after one paper is printed, the "High" or "Low" of the printing rate flag is decided by a condition of step 7 that "an average printing rate of immediately previous 100 papers is equal to or more than 10%" which will be described later, and is updated as needed.

When the printing rate flag is "High" (YES in step S2), the primary transfer bias control unit 53 switches polarity of primary transfer bias, except for the time of image formation, to polarity opposite to charged polarity of toner (step S3). In the present embodiment, the primary transfer bias, except for the time of image formation, indicates primary transfer bias of a blank part immediately before an image, a blank part between images, and a blank part after an image.

When the printing rate is high, since a ratio of metal particles, which are polishing particles of collected toner, becomes high, the charging device 4 is easily contaminated. The metal particles are stirred in a metal particle device in the cleaning device and charged with the same polarity as that of the toner. In this regard, the primary transfer bias with polarity opposite to the charged polarity of the toner is applied to the primary transfer roller 6, so that it is possible to suppress the contamination of the charging device 4 due to the metal particles.

On the other hand, when the printing rate flag of each color is not "High" (which is "Low") (NO in step S2), the primary transfer bias control unit 53 allows the polarity of the primary transfer bias, except for the time of image formation, to polarity equal to the charged polarity of the toner (step S4).

When the printing rate is low, since the ratio of the metal particles, which are the polishing particles of the collected toner, becomes low. The metal particles of the collected toner release an electric charge, and when the ratio of the metal particles of the collected toner is low, the toner is excessively electrified by friction in the cleaning device 3. When the toner is peeled from the photosensitive drum 1 by the cleaning blade 31, the toner is discharged to the photosensitive drum 1, so that the dielectric breakdown of the photosensitive drum 1 occurs. In this regard, the primary transfer bias with the same polarity as that of the charged polarity of the toner is applied to the primary transfer roller 6, so that the ratio of the metal particles of the collected toner in the cleaning device 3 increases. Therefore, it is possible to suppress the dielectric breakdown of the photosensitive drum 1.

Then, when one page is printed (step S5), a printing rate of each color of one page is calculated by the calculation unit 97 (step S6), and it is determined whether an average printing rate of each color of immediately previous 100 papers is equal to or more than 10% (step S7). In addition, even though the accumulated number of printed papers is less than 100 papers, the calculation unit 97 calculates the average printing rate from the number of intermediately previous printed papers.

When the average printing rate is equal to or more than 10% (YES in step S7), the printing rate flag of each color is allowed to be "High" (step S8).

On the other hand, when the average printing rate is not equal to or more than 10% (NO in step S7), the printing rate flag of each color is allowed to be "Low" (step S9).

Subsequently, it is determined whether there is printing of subsequent pages (step S10). When there is the printing of the subsequent pages (YES in step S10), the procedure returns to step S2. On the other hand, when there is no printing of the subsequent pages (NO in step S10), the printing operation is ended (step S11).

By the aforementioned procedure, it is possible to maintain a ratio of metal particles and the like in the cleaning device of each station in a predetermined range. Consequently, it is possible to suppress contamination of the charging device of each station due to external additives and dielectric breakdown of the photosensitive drum.

In the present embodiment, in step S7, it is determined whether the average printing rate of immediately previous 100 papers is equal to or more than 10%; the present invention is not limited thereto. Photosensitive drums can also be ranked in a descending order of an average printing rate of a predetermined number of immediately previous papers, and the processes after step S8 can also be similarly performed for at least one (for example, one) photosensitive drum in the descending order. In this case, it is possible to more accurately control the ratio of metal particles and the like in the cleaning device of each station.

In addition, in the present embodiment, the photosensitive drum 1 may also be made of any one of amorphous silicon and OPC; however, it is preferable that the photosensitive drum 1 is made of the amorphous silicon.

It should be noted that the embodiments disclosed herein are illustrative in all respects and are not restrictive. The scope of the present invention is defined by the scope of the appended claims rather than the description of the aforementioned embodiments, and is intended to include all modifications within the meaning and scope equivalent to the scope of the appended claims.

The image forming apparatus of the present invention, for example, can be applied to a copy machine, a printer, a facsimile and the like.

What is claimed is:

1. An image forming apparatus, comprising a plurality of photoreceptors;

charging devices that contact and charge respective photoreceptors;

developing devices that attach toner including a metal particle, which is a polishing particle, and develop latent images; and cleaning devices that remove remaining toner from surfaces of the photoreceptors, wherein toner images of each color are formed on the photoreceptors to be sequentially superposed on an intermediate transfer belt to form a color image, the image forming apparatus further comprising a primary transfer bias control unit that switches polarity of primary transfer bias, except for a time of image formation on the photoreceptors, to polarity equal to or opposite to electrostatic charge of toner in response to an average printing rate of each color of a predetermined number of immediately previous papers.

2. The image forming apparatus of claim 1, wherein the primary transfer bias, except for the time of image formation, indicates primary transfer bias of a blank part immediately before an image, a blank part between images, and a blank part after an image.

3. The image forming apparatus of claim 1, wherein for a photoreceptor in which the average printing rate of a predetermined number of immediately previous papers is higher than a predetermined printing rate, the polarity of the primary transfer bias, except for the time of image formation, is switched to polarity opposite to charged polarity of the toner, and for a photoreceptor in which the average printing rate of a predetermined number of immediately previous papers is lower than the predetermined printing rate, the polarity of the primary transfer bias, except for the time of image formation, is switched to polarity equal to the charged polarity of the toner.

4. The image forming apparatus of claim 1, wherein for at least one photoreceptor in which the average printing rate of a predetermined number of immediately previous papers is high, the polarity of the primary transfer bias, except for the time of image formation, is switched to polarity opposite to charged polarity of the toner, and for other photoreceptors, the polarity of the primary transfer bias, except for the time of image formation, is switched to polarity equal to the charged polarity of the toner.

5. The image forming apparatus of claim 1, wherein the photoreceptors are made of amorphous silicon.

* * * * *